US009232326B2

(12) United States Patent
Hannemann

(10) Patent No.: US 9,232,326 B2
(45) Date of Patent: Jan. 5, 2016

(54) METHOD FOR DETERMINING A COMPRESSION CHARACTERISTIC, METHOD FOR DETERMINING A KNEE POINT AND METHOD FOR ADJUSTING A HEARING AID

(71) Applicant: SIVANTOS PTE. LTD., Singapore (SG)

(72) Inventor: Ronny Hannemann, Buckenhof (DE)

(73) Assignee: Sivantos Pte. Ltd., Singapore (SG)

( * ) Notice: Subject to any disclaimer, the term of this patent is extended or adjusted under 35 U.S.C. 154(b) by 364 days.

(21) Appl. No.: 13/656,876

(22) Filed: Oct. 22, 2012

(65) Prior Publication Data

US 2013/0101123 A1 Apr. 25, 2013

(30) Foreign Application Priority Data

Oct. 21, 2011 (DE) ..... 10 2011 085 036

(51) Int. Cl.
*H04R 25/00* (2006.01)

(52) U.S. Cl.
CPC ..... *H04R 25/70* (2013.01); *H04R 25/353* (2013.01); *H04R 25/552* (2013.01); *H04R 2225/43* (2013.01)

(58) Field of Classification Search
USPC ..... 381/60, 312, 316, 320
See application file for complete search history.

(56) References Cited

U.S. PATENT DOCUMENTS

| | | | | |
|---|---|---|---|---|
| 2004/0264721 | A1 | 12/2004 | Allegro et al. | |
| 2009/0220109 | A1* | 9/2009 | Crockett et al. | 381/107 |
| 2011/0142271 | A1 | 6/2011 | Tiefenau | |
| 2011/0249843 | A1* | 10/2011 | Holmberg et al. | 381/316 |

FOREIGN PATENT DOCUMENTS

DE 10 2009 058 415 A1 6/2011

OTHER PUBLICATIONS

Bürkli-Halvey, et al., Verbesserty Hörbarkeit für Menschen mit hochgradigem HörverlustÅ, 2008, pp. 8-14, Höraukustik (Magazine).

Keiichi Yasu et al; "Critical-band based frequency compression for digital hearing aids"; Jan. 1, 2004, XP055120887, DOI: 10.1250/ast.25.61; found on the Internet May 30, 2014,I URL:http://www.splab.net/papers/2004/2004_05.pdf.

H. Traunmuller: "Analytical expressions for the tonotopic sensory scale" Journal of the Acoustical Society of America, vol. 88, No. 1, Jul. 1, 1990, pp. 97-100, XP055122062 URL:http://scitation.aip.org/docserver/fulltext/asajournal/jasaj88/1/1.399849.pdf?expires=1402041200&id=id&accname=441685&checksum=C9F9CDB8CBE826BDFFBB014D79C6F620 [found on Jun. 6, 2014].

* cited by examiner

*Primary Examiner* — Ahmad F Matar
*Assistant Examiner* — Sabrina Diaz
(74) *Attorney, Agent, or Firm* — Laurence Greenberg; Werner Stemer; Ralph Locher

(57) ABSTRACT

The fitting of a hearing device and in particular of a hearing aid using frequency compression is to be simplified. A method for determining a knee point of a frequency compression characteristic for a hearing device is therefore proposed wherein a maximum audible frequency of a hearing device user is first determined and the knee point is then determined using a predefined rule in dependence on a maximum audible frequency. An end point of a compression characteristic can also be automatically determined.

6 Claims, 3 Drawing Sheets

METHOD FOR DETERMINING A COMPRESSION CHARACTERISTIC, METHOD FOR DETERMINING A KNEE POINT AND METHOD FOR ADJUSTING A HEARING AID

CROSS-REFERENCE TO RELATED APPLICATION

This application claims the priority, under 35 U.S.C. §119, of German application DE 10 2011 085 036.8, filed Oct. 21, 2011; the prior application is herewith incorporated by reference in its entirety.

BACKGROUND OF THE INVENTION

Field of the Invention

The present invention relates to a method for determining a knee point of a frequency compression characteristic for a hearing device. The present invention also relates to a method for determining a frequency compression characteristic and a method for adjusting a binaural hearing system. The term hearing device is to be understood here as meaning any auditory stimulus triggering instrument that can be worn in or on the ear, in particular a hearing aid, headphones and the like.

Hearing aids are portable hearing devices for use by the hard of hearing. In order to meet the numerous individual requirements, different hearing aids types are available, such as behind-the-ear (BTE) hearing aids, hearing aid with external receiver (RIC: receiver in the canal) and in-the-ear (ITE) hearing aids, e.g. concha or completely-in-canal (ITE, CIC) devices. The hearing instruments listed by way of example are worn on the outer ear or in the auditory canal. However, bone conduction hearing aids, implantable or vibrotactile hearing aids are also commercially available. In these cases, the damaged hearing is stimulated either mechanically or electrically.

The basic components of a hearing aid are essentially an input transducer, an amplifier and an output transducer. The input transducer is generally a sound pickup device, e.g. a microphone, and/or an electromagnetic pickup such as an induction coil. The output transducer is mainly implemented as an electroacoustic transducer, e.g. a miniature loudspeaker, or as an electromechanical transducer such as a bone conduction receiver. The amplifier is usually incorporated in a signal processing unit. This basic configuration is shown in FIG. 1 using the example of a behind-the-ear hearing aid. Installed in a hearing aid housing 1 for wearing behind the ear are one or more microphones 2 for picking up sound from the environment. A signal processing unit 3 which is likewise incorporated in the hearing aid housing 1 processes the microphone signals and amplifies them. The output signal of the signal processing unit 3 is transmitted to a loudspeaker or receiver 4 which outputs an audible signal. The sound is in some cases transmitted to the wearer's eardrum via a sound tube which is fixed in the auditory canal using an earmold. The hearing aid and in particular the signal processing unit 3 are powered by a battery 5 likewise incorporated in the hearing aid housing 1.

Frequency compression is a relatively new technique for hearing aids. Frequency compression makes high frequency information audible that would be inaudible without this process. This is achieved by an algorithm which maps high frequency information from higher to lower frequencies, originally low frequencies being replaced with the new information.

To make the frequency compression algorithm beneficial also in terms of speech intelligibility, the algorithm must be parameterized in a specific manner. However, it cannot currently be reliably demonstrated that using a frequency compression algorithm is likely to provide advantages in terms of speech intelligibility. In particular, there is no clearly defined strategy for parameterizing a frequency compression algorithm so as to provide a benefit with regard to speech intelligibility. As speech intelligibility is very important in enabling hearing-impaired people to participate satisfactorily in everyday conversations, and in ensuring that they are comfortable with their hearing aid, it is accordingly important to be able to achieve better speech intelligibility with hearing aids.

Techniques currently used to adjust frequency compression algorithms do not take into account the acoustic microstructure of consonants and vowels such as their center frequency or other characteristics, e.g. formants. Today's fitting strategies which are applied during a first fitting are aimed at increased feedback stability rather than improved speech intelligibility. An additional benefit in respect of speech intelligibility can only be achieved by extremely laborious and time-consuming manual fine tuning.

U.S. patent publication No. 2011/0249843 A1 describes a method for determining a knee point of a frequency compression characteristic for a hearing aid. Here a critical frequency within the frequency range is determined, the input signal is analyzed, a cutoff frequency is defined, a source frequency above the cutoff frequency is defined, and a target band below the cutoff frequency is identified.

Published, non-prosecuted German patent application DE 10 2009 058 415 A1, corresponding to U.S. patent publication No. 20110142271, describes a method for determining sounds and in particular the fundamental frequencies thereof present in a hearing aid input signal and performing frequency transpositions as a function of the fundamental frequencies determined. The transposed harmonics are re-applied to the frequency grid of the fundamental frequency so that the sound property is retained even after frequency transposition.

The article "Verbesserte Hörbarkeit für Menschen mit hochgradigem Hörverlust" (Improved Audibility for People with Severe Hearing Loss) by O. Bürkli-Halevy et al., published in Hörakustik 3, 2008, pages 8 to 14, describes using frequency compression with a compression ratio of between 1.5:1 and 4:1 for hearing aids.

SUMMARY OF THE INVENTION

The object of the present invention is therefore to enable the frequency compression of a hearing device to be adjusted in a simple manner such that benefits in terms of speech intelligibility can be achieved.

The object is achieved according to the invention by a method for determining a knee point of a frequency compression characteristic for a hearing device. The method includes determining a hearing device user's maximum audible frequency, and determining the knee point using a predefined rule in dependence on the maximum audible frequency. Parameters of the frequency compression characteristic are constituted on a basis of frequency groups.

Advantageously, the knee point of the frequency compression characteristic is therefore determined in dependence on the hearing device user's maximum audible frequency (i.e. the highest frequency audible to the user), it being assumed that the frequency compression characteristic has at least two legs which are joined at the knee point. By suitably shifting the knee point according to the predefined rule, the information which can be transmitted to the hearing device user in the audible range can thus be optimized.

The knee point is preferably set at above 1.5 kHz in each case. Since below the knee point the frequencies are typically transmitted uncompressed, if the knee point is above 1.5 kHz all the essential spectral components which enable the user to distinguish between female voices and male voices are transmitted unchanged.

The knee point can be calculated using the Bark scale. The Bark scale is a psychoacoustical scale for perceived loudness (critical bands).

A coordinate f_cutoff of the knee point is calculated using the formula:

$$f_cutoff=1960\cdot((f_max_bark-no_bands_down+0.53)/(26.28-(f_max_bark-no_bands_down)),$$

where f_max_bark is the maximum audible frequency converted into a Bark value and no_bands_down is a number of frequency groups (critical bands) determined as a function of the maximum audible frequency. Therefore, in an assignment rule it only remains to determine the size of the no_bands_down value in units of frequency groups (critical bands) as a function of the maximum audible frequency. This value can be determined analytically for each frequency or else e.g. in tabular form for individual frequency channels.

In a development, a method for determining a frequency compression characteristic according to which an input value is mapped to an output value can therefore be provided by determining a knee point as per the above method, wherein below the knee point each input value is equal to the respective output value. The lower part of a frequency compression characteristic is therefore defined from zero frequency up to the knee point frequency in any event. No compression takes place in this frequency range.

Above the knee point, compression typically takes place. Here the compression rate must not exceed the value 4. Higher compression rates result in annoying transmissions.

Here too the input value f_source_max for the output value f_max corresponding to the maximum audible frequency can be calculated using the Bark scale. The algorithm for adjusting the frequency compression is therefore brought closer to the psychoacoustic magnitude of the actually perceivable loudness.

In order to specifically define the frequency compression characteristic above the knee point, the input value f_source_max for the maximum audible output value f_max can be calculated using the formula $$f_source_max=1960\ ((f_{}_{max}_bark+no_bands_up)+0.53)/(26.28-(f_{}_{max}_bark+no_bands_up)),$$

where f_max_bark is the maximum audible frequency converted into a Bark value and no$_{}_{bands}_$up is a number of frequency groups (critical bands) defined as a function of the maximum audible frequency. Once again it is then only necessary to define for each maximum audible frequency f_max, or rather the highest audible channel, a number of frequency groups whose total width constitutes the spacing from the knee point (f_cutoff) to the original frequency f_source_max which is mapped to the maximum audible frequency f_max according to the compression characteristic.

Using the above described inventive determination of the frequency compression characteristic, a method for automatically adjusting a binaural hearing system can be provided. Here it is particularly advantageous if the frequency compression characteristic just described is determined for the hearing device user's ear having the less severe hearing loss. This ensures that information that the hearing device user could still hear is not lost to that user.

Other features which are considered as characteristic for the invention are set forth in the appended claims.

Although the invention is illustrated and described herein as embodied in a method for determining a compression characteristic, method for determining a knee point and method for adjusting a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
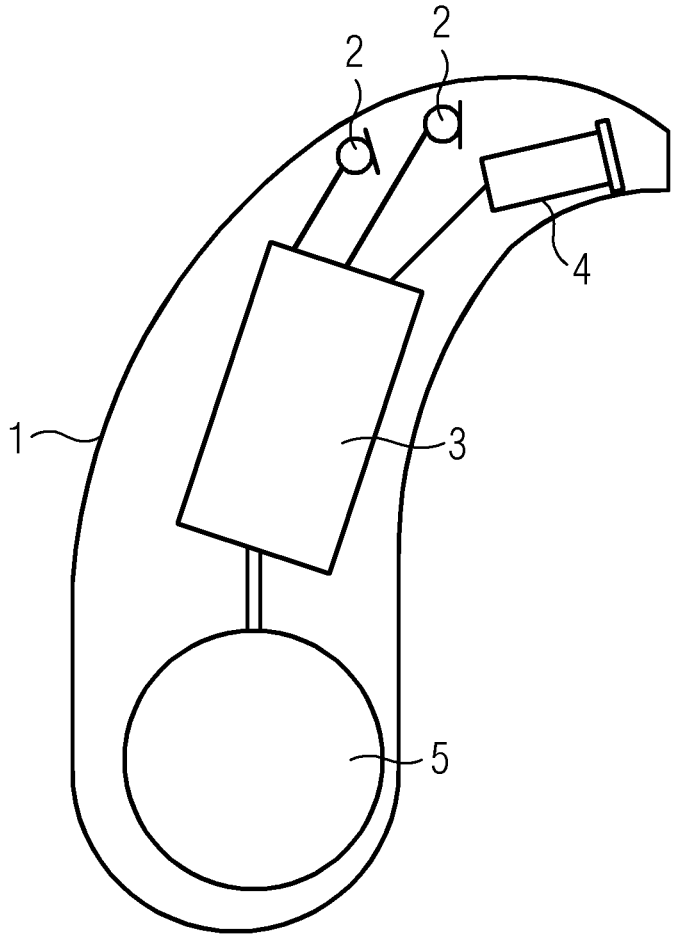
FIG 1 PRIOR ART
FIG. 1 is a basic illustration of a hearing aid according to the prior art.

The examples described in greater detail below represent preferred embodiments of the present invention.

The adjustment or fitting algorithm described below is configured to adjust a frequency compression algorithm of a hearing aid or other hearing device so as to produce a benefit in terms of speech intelligibility compared to the case of a hearing aid without frequency compression. All the other parameters of the hearing aid except for the frequency compression are unchanged (gain, level compression, etc.).

In the hearing aid, a frequency compression algorithm is implemented whose frequency compression characteristic 10 (compare FIG. 3) represents the mapping of an input frequency f_in (=f_source) to an output frequency f_out (=f_destination). The frequency compression characteristic 10 usually possesses the structure shown in FIG. 3. It has two linear sections 11 and 12, the first section 11 extending from the origin of the graph to a knee point 13, and the second linear section 12 from the knee point 13 to an end point 14. The first linear section 11 has unity slope, so that no frequency compression takes place in the frequency range from zero to the knee point 13, i.e. the frequency f_cutoff.

The frequency compression characteristic is therefore characterized by three parameters: the frequency f_cutoff which represents the two coordinates of the knee point 13 and corresponds to the start point of the actual frequency compression algorithm (all the frequencies below f_cutoff are unaffected by the algorithm), the frequency f_max which represents the maximum audible frequency, and the frequency f_source_max which corresponds to the original input frequency which is mapped to the output frequency f_max by the frequency compression characteristic. The information in the original frequency range between f_cutoff and f_source_max is therefore mapped to the range between f_cutoff and f_max. This reduction in bandwidth results in audibility of high frequency information at lower frequencies at the expense of a loss of original low frequency information. However, an advantageous fitting formula for the frequency compression algorithm fulfills the following audiological requirements:

1. The audibility of fricatives is increased. In particular, with the frequency compression algorithm activated, the center frequency of the sound "s" shall be different from that of the sound "sh".
2. Confusion between the vowels "e" and "i" shall be minimized. With the frequency compression algorithm activated, the shifted frequencies of the second vowel formant of "e" and "i" shall be different from one another, preferably independently of the fulfillment of the other requirements.
3. As much original information as possible shall be retained. In other words: the loss of original frequency information shall be minimized. The knee point, i.e. f_cutoff, shall therefore be as high as possible, and the resulting frequency compression rate shall be as small as possible with regard to the other requirements. In particular, however, the frequency compression rate must not exceed the value 4.
4. In the case of binaural supply, the frequency compression algorithm shall always be adapted to the ear having the better hearing.
5. In the case of binaural supply, the same adjustment of the frequency compression algorithm shall be applied in both hearing instruments in order to achieve a consistent impression of sound on both ears, so that cortical re-learning of auditory perception is possible.
6. The distinguishability of speech examples of both sexes shall be ensured.

The frequency f_cutoff of the knee point 13 shall not therefore be below 1.5 kHz.

The fact as to whether a hearing device user is suitable for frequency compression according to the invention can be reliably assessed using two measurements. These measurements shall be carried out on the ear having the better residual hearing. The first measurement is equivalent to an audiogram and the second measurement relates to the presence of a so-called dead region in the user's hearing. On the basis of the audiogram alone it is generally not reliably possible to determine the maximum audible frequency. This is due to the fact that, for example, on the basilar membrane, hairs are not excited directly to vibrate by the sound waves, but also by vibrations of the basilar membrane itself. Sound is therefore audible, for example, that is beyond an actual maximum audible frequency. In order to be able to better determine the maximum audible frequency, a dead region, for example, or rather the lower limit thereof, is determined using the so-called TEN test (see below).

A benefit achievable by a hearing aid can be calculated on the basis of a given audiogram and a selected fitting formula (e.g. ConnexxFit). Calculating the hearing aid output spectrum enables the maximum audible frequency to be estimated with the respective adjustment. The point of intersection of the hearing aid output spectrum with the hearing loss (audiogram) determines the so-called maximum audible frequency f_max.

The maximum audible frequency f_max can be evaluated, for example, using the following steps:

a) Determining the 99% percentile of speech-modulated 65 dB noise (e.g. ISTS noise(International Speech Test Signal) in accordance with the international standard IEC 60118-15).
b) Calculating the gain of the hearing aid in the inserted state (insertion gain) for an existing hearing loss using a fitting algorithm or static model for a specific hearing aid.
c) Adding the results of a) and b). This corresponds to the frequency spectrum (aided speech spectrum) at the eardrum.
d) Calculating the point of intersection of the existing audiogram using the result of c), which yields the maximum audible frequency f_max.

If other percentiles or other ISTS noise levels are used in a), the frequency compression adaptation can be adapted to specific requirements (other hearing aid categories or particular sub-groups of hearing-impaired persons).

If a so-called dead region is estimated on the basis of the audiogram or measured using another diagnostic test (e.g. the TEN test), the calculated maximum audible frequency f_max can be changed to the resulting value. A dead region may be present if a hearing loss is at least 80 dB (HL=Hearing Level) at a particular frequency and the difference between two adjacent octaves is at least 50 dB (HL).

Figure 2:
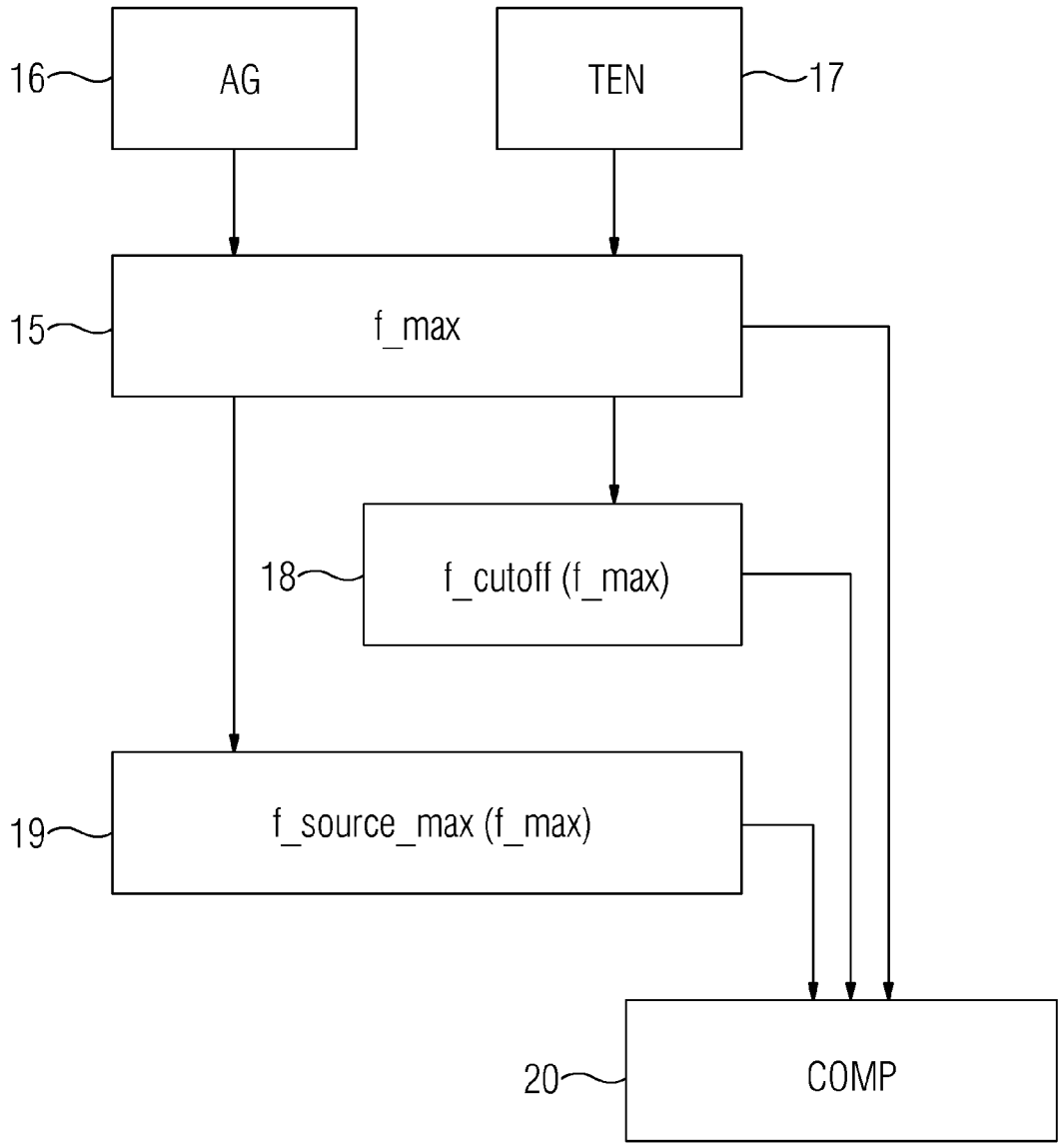
FIG. 2 is a block schematic for determining a frequency compression characteristic according to the invention.
Figure 3:
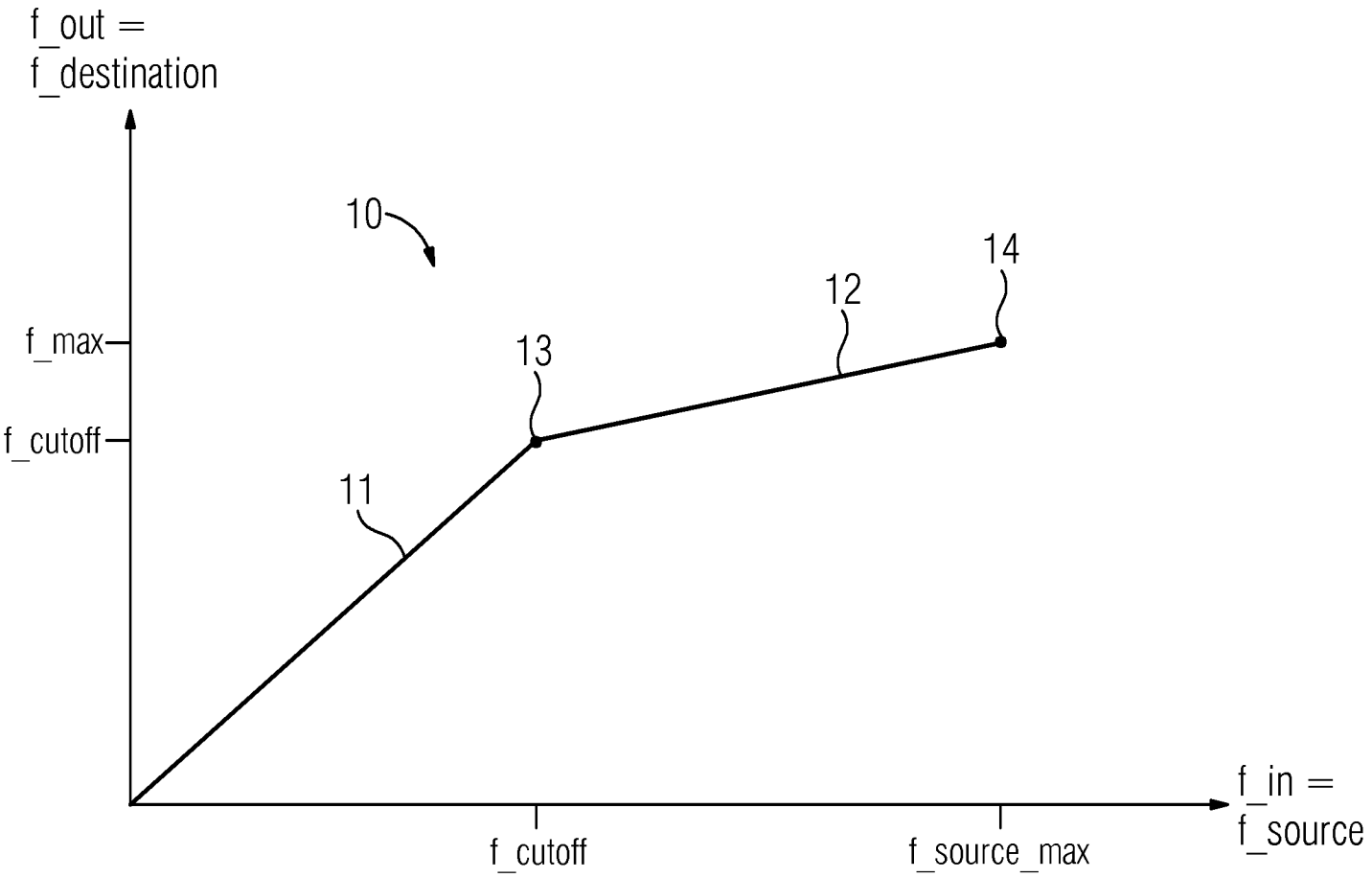
FIG. 3 is a graph showing a frequency compression characteristic according to the invention.

It will now be shown with reference to FIG. 2 and FIG. 3 how a frequency compression characteristic can be automatically determined. For this purpose the parameters of the frequency compression characteristic f_cutoff and f_source_max are preferably determined on the basis of frequency groups (critical bands), see Bark scale and Eberhard Zwicker: "Subdivision of the Audible Frequency Range into Critical Bands (frequency groups)", J. Acoust Soc. Am. Vol. 33, page 248, Feb. 1961). The starting point for the calculations is the maximum audible frequency f_max which also corresponds to the lower frequency of a dead region. In step 15, the maximum audible frequency f_max is therefore determined from the audiogram, which was itself measured in step 16, and possibly the TEN test which was carried out in step 17. As a function of this frequency f_max, the frequency f_cutoff which represents the coordinates of the knee point 13 is determined in step 18. In addition, in step 19 the maximum source frequency f_source_max which is mapped to precisely the frequency f_max is determined in dependence on the frequency f_max. Finally, in step 20 a frequency compression characteristic 10 with which the frequency compression algorithm is adjusted is determined from the parameters f_max, f_cutoff and f_source_max.

The resulting algorithm produces a frequency compression adjustment ensuring improved speech intelligibility.

The value of f_max is preferably transformed to a Bark value f_max_bark in accordance with a method of H. Traunmüller (1990) "Analytical Expressions for the Tonotopic Sensory Scale" J. Acoust Soc. Am. 88: pages 97 to 100.

The transformation is performed according to the formula $$f_max_bark=26.81\cdot f_max/(1960+f_max)-0.53.$$

The value f_max_bark shall optionally be variable if, for example, less frequency compression is required. It shall then be ensured, for example, for a predefined filter bank that the changed value f_max_bark represents a frequency between 2 and 8 kHz.

The frequency f_cutoff of the knee point can be calculated using the formula below and the no_bands_down values which represent a number of frequency groups. The knee point is therefore at a particular spacing (counted in frequency groups) below the maximum audible frequency f_max. The corresponding formula is:

$$f_cutoff=1960\cdot((f_max_bark-no_bands_down)+0.53)/(26.28-(f_max_bark-no_bands_down)).$$

Using the described algorithm, values for f_max<2 kHz would become f_cutoff values<1.5 kHz, which is to be avoided from an audiological point of view. Therefore, values for f_max<2 kHz are always set to 2 kHz, irrespective of the value actually measured.

Using the following formula and the no_bands_up values listed in the table below likewise in "CB" (critical bands), the further characteristic parameter f_source_max can be calculated for a respective actual frequency f_max:

$$f_source_tmp=1960\cdot((f_max_bark+no_bands_up)+0.53)/(26.28-(f_max_bark+no_bands_up))$$

| f_max in [Hz] | No_bands_down in [CB] | No_bands_up in [CB] |
|---|---|---|
| 1500 | 3 | 7 |
| 1750 | 2 | 6 |
| 2000 | 2 | 5.5 |
| 2250 | 2 | 4.8 |
| 2500 | 1.8 | 4 |
| 2750 | 2 | 3.8 |
| 3000 | 2 | 3.2 |
| 3250 | 2 | 3 |
| 3500 | 2 | 2.5 |
| 3750 | 2 | 2.3 |
| 4000 | 2 | 2.2 |
| 4250 | 1.8 | 2 |
| 4500 | 2 | 2 |
| 4750 | 2 | 1.8 |
| 5000 | 1.8 | 1.7 |
| 5250 | 2 | 1.6 |
| 5500 | 1.8 | 1.5 |
| 5750 | 1.8 | 1.6 |
| 6000 | 1.6 | 1.5 |
| 6250 | 1.6 | 1.5 |
| 6500 | 1.6 | 1.4 |
| 6750 | 1.6 | 1.4 |
| 7000 | 1.8 | 1.5 |
| 7250 | 1.8 | 1.4 |
| 7500 | 2 | 1.3 |
| 7750 | 2 | 1.2 |
| 8000 | 2 | 1.2 |

The above calculations ensure that the audiological requirements 1. and 2. (see above) are met. These requirements are the basis for improving speech intelligibility by use of the frequency compression algorithm. The values in the table are here referred to a filter bank with 48 channels each having a bandwidth of 250 Hz.

The described fitting strategy for a frequency compression algorithm combines a plurality of hearing aid fitting steps which are usually carried out manually (e.g. measurements on 2 $cm^3$ test volumes). For example, the hearing threshold resulting from wearing the hearing aid is used for estimating the maximum audible frequency, likewise the otherwise usual manual isolating of the center frequencies of the fricatives "s" and "sh" during hearing aid fitting. The manual method for separating "s" and "sh" is now inventively automated. With the automatic fitting proposed, the critical bandwidths concept (frequency groups according to the Bark scale) is used so as to ultimately produce clear benefits in respect of speech intelligibility with automatic adaptation of frequency compression. After just a short phase of accustomization to the changed sound impression due to frequency compression, the hearing-impaired subjects show improved speech intelligibility.

The inventive strategy for adapting a frequency compression algorithm provides on the one hand a measurable improvement in speech intelligibility with frequency compression activated and, on the other hand, faster fitting of the hearing aids using frequency compression algorithms. In particular, fitting can now be automated and requires no lengthy measurements and fitting sessions. In addition, a prediction of an additional benefit in respect of speech intelligibility using frequency compression is also possible. Another advantage is that improved speech intelligibility is apparent even after the first fitting.

The invention claimed is:

1. A method for determining a knee point of a frequency compression characteristic for a hearing device, which comprises the steps of:

determining a maximum audible frequency of a hearing device user;

determining the knee point by means of a predefined rule in dependence on the maximum audible frequency, parameters of the frequency compression characteristic constituted on a basis of frequency groups;

calculating the knee point using Bark scale values; and calculating a coordinate $f_{13}$ cutoff of the knee point using the formula:

$$f_cutoff=1960\cdot((f_max_bark-no_bands_down+0.53)/(26.28-(f_max_bark-no_bands_down)),$$

where f_max_bark is the maximum audible frequency converted into a Bark value, and no_bands_down is a number of frequency groups defined in dependence on the maximum audible frequency.

2. The method according to claim 1, wherein the knee point is in each case set above 1.5 kHz.

3. A method for determining a frequency compression characteristic, which comprises the steps of:

mapping an input value to an output value by determining a knee point of the frequency compression characteristic for a hearing device, the knee point being determined by the further steps of:

determining a maximum audible frequency of a hearing device user;

determining the knee point by means of a predefined rule in dependence on the maximum audible frequency, parameters of the frequency compression characteristic being constituted on a basis of frequency groups; and wherein below the knee point each said input value is equal to a respective said output value;

calculating the input value $f_{13}$ source_max for the output value $f_{13}$ max, corresponding to the maximum audible frequency using a Bark scale, and the formula:

$$f_source__{max}=1960\cdot((f_max_bark+no_bands_up)+0.53)/(26.28-(f_max_bark+no_bands_up)),$$

where $f_{13}$ max_bark is the maximum audible frequency ($f_{13}$ max) converted into a Bark value, and no_bands_up is a number of frequency groups defined as a function of the maximum audible frequency.

4. The method according to claim 3, which further comprises setting a maximum compression rate to be 4.

5. A method for adjusting a binaural hearing system containing two hearing devices using the step of determining the frequency compression characteristic according to claim 3.

6. The method according to claim 5, wherein the frequency compression characteristic is determined for the hearing device user's ear having a lower hearing loss.

* * * * *